United States Patent [19]

Rizzuto

[11] Patent Number: 4,904,830

[45] Date of Patent: Feb. 27, 1990

[54] LIQUID SHUT-OFF SYSTEM

[76] Inventor: Anthony B. Rizzuto, 10 Deerfield Dr., Florham Park, N.J. 07932

[21] Appl. No.: 316,661

[22] Filed: Feb. 28, 1989

[51] Int. Cl.[4] ..... H01H 35/18

[52] U.S. Cl. ..... 200/84 R; 137/362; 137/312; 137/412

[58] Field of Search ..... 137/312, 412, 362; 200/84 R

[56] References Cited

U.S. PATENT DOCUMENTS

| | | | |
|---|---|---|---|
| 3,473,553 | 10/1969 | Collins | 137/412 X |
| 3,944,770 | 3/1976 | Pepper | 200/84 R |
| 4,223,190 | 9/1980 | Olson | 200/84 R |
| 4,305,420 | 12/1981 | Nussdorf | 200/84 R |
| 4,418,712 | 12/1983 | Braley | 137/312 |
| 4,540,891 | 9/1985 | Keener | 200/84 R |
| 4,778,951 | 10/1988 | Crowell | 200/84 R |
| 4,796,658 | 1/1989 | Caple | 137/312 |
| 4,805,662 | 2/1989 | Moody | 137/212 |

*Primary Examiner*—Alan Cohan

*Attorney, Agent, or Firm*—Bernard J. Murphy

[57] ABSTRACT

The System is designed to shut-off the flow of liquid in a conduit, unattended, i.e., automatically, in the event of a liquid conduit rupture, liquid overflow, or the like. A float which carries a mercury switch is set over a recess formed therefor and into which liquid can flow and collect. The float rises with the collected liquid, and the mercury switch activates a solenoid valve which is interpositioned in a pressured-liquid conduit, to halt the flow of liquid through the conduit. The recess is formed in a lowermost portion of an area in which the subject conduit is sited.

3 Claims, 1 Drawing Sheet

LIQUID SHUT-OFF SYSTEM

This invention pertains to liquid shut-off systems, and in particular to a novel system which shuts off the flow of liquid in a conduit, unattended, i.e., automatically, in the event of a liquid conduit rupture, liquid overflow, or the like.

By way of example, in private homes it is customary to have hot and cold water hoses coupled to a clothes washing machine, with the hoses connected to live, open taps. The washing machine is programmed to turn on and off each of the water lines as necessary. However, the hoses fatigue, and rupture, and permit water to flood the area in which the machine is sited. This is especially unfortunate where the machine is located in a remote site—cellar, or distant laundry room. It can be some time before the homeowner is aware of the fact that flooding is occurring.

What has been needed is a liquid shut-off system which will function, unattended, when such flooding first commences.

It is an object of this invention, then, to set forth just such a long sought system.

Particularly it is an object of this invention to disclosure a liquid shut-off system comprising a solenoid valve; said valve having means for coupling interpositioning thereof in a pressured-liquid line or conduit; a source of electrical power; power lines for electrically coupling said solenoid valve with said power source; and means interpositioned in at least one of said power lines for inhibiting and permitting a flow of electrical power between said source and said solenoid valve; wherein said power flow inhibiting and permitting means is carried by a float means which is buoyant in liquid.

It is a further object of this invention to set forth a float switch, for use in a liquid shut-off system, comprising a shell; a pivot pin fixed in said shell and in traverse thereof; a sleeve rotatably encompassing an intermediate portion of said pin; a buoyant element at one end thereof to said sleeve; and a liquid switch carried by said element.

Further objects of this invention, as well as the novel features thereof, will become more apparent by reference to the following description, taken in conjunction with the accompanying figures, in which.

Figure 1:
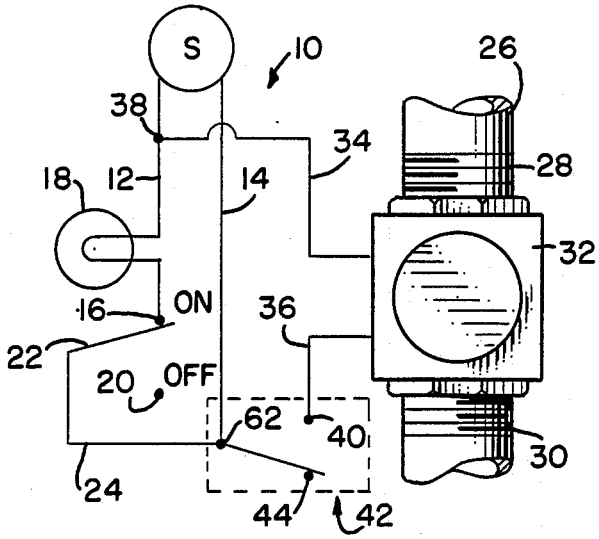
FIG. 1 is a composite of a schematic of the electrical circuitry, and pictorial of the solenoid valve and liquid conduit, according to an embodiment of the invention.
Figure 4:
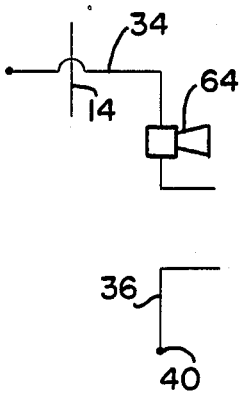
FIG. 4 is a partial schematic, showing the ancillary power lines which connect with the solenoid valve, and an alternative feature incorporating an audible alarm.

As shown in the figures, the novel liquid shut-off system 10, according to an embodiment thereof, comprises a source "S" of power, and a pair of primary power lines 12 and 14 proceeding therefrom. Line 12 communicates with a neon lamp and then terminates at a switch terminal 16. The lamp 18 is provided to give a visual signal that the system 10 is "on". Switch terminal 16 and companion terminal 20 are parts of an ON/OFF switch 22, the contactor of which is electrically coupled, via a line 24, to line 14.

With the switch 22 in the "on" position, as shown, the neon lamp will illuminate.

A conduit 26, having threaded ends 28 and 30, carries—for instance—hot water to a household. The threaded ends 28 and 30 receive a solenoid valve 32. Ancillary power lines 34 and 36 are connected to the solenoid valve 32, and line 34 is further connected, via connector 38 to line 12. Line 36 terminates at a terminal 40 which is a constituent of the novel float switch 42. As shown in FIG. 1, the contactor of switch 42 is engaged with a dead terminal 44. It is necessary for the contactor to engage terminal 40 to enable the solenoid valve 32, to cause the latter to shut off the conduit 26.

Figure 3:
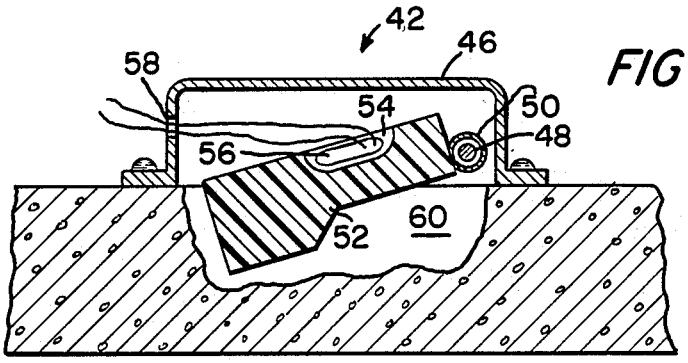
FIG. 3 is a cross-sectional view, taken along section 3—3 of FIG. 2.
Figure 2:
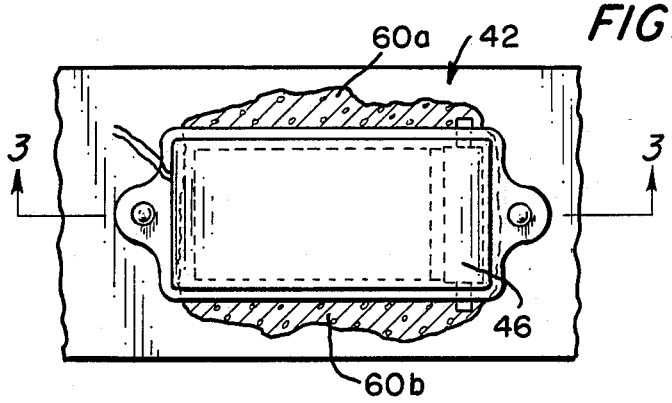
FIG. 2 is a plan view of the novel float switch, according to an embodiment thereof, used in the system of FIG. 1.

The float switch 42 comprises a shell 46 in which a pivot pin 48 is fixed in traverse thereof. The pin 48 receives a sleeve 50, about an intermediate portion thereof, freely rotatably. A body of foam plastic 52 is secured, by cement, at an end thereof, to the sleeve 50. In turn, the body has a cavity 54 formed therein in which is nested a mercury switch 56. Switch 56 is strapped or otherwise banded to the body 52 (by means not shown); alternatively, it can be cemented in place in the cavity. Electrical lines from the mercury switch 56 pass through an aperture 58 formed therefor in the shell 46. As can be seen, in FIGS. 2 and 3, the shell 46 has an unapertured top, and a continuous wall which depends from the top. The wall has only (a) a pair of apertures in opposite sides thereof in which the pivot pin 48 is received, and (b) the aperture 58 through which the aforesaid electrical lines pass. Accordingly, the float switch has no apparent means for admitting overflow liquid thereinto. This is so, as explained in the ensuing text, because the overflow liquid (water, oil, or the like) must enter beneath the float switch 42. The switch must be fixed over a cavity.

To use the system, one has only to form a small cavity or depression 60 in the lowermost portion of the area in which the system is to be employed. The depression has only to accommodate the pendant body 52, and should have portions **60*a* and/or 60*b* outboard of the shell 46** to admit liquid flow.

With the shell 46 fastened over the depression 60, the float switch will sense the onset of a flooding condition. Liquid from a ruptured conduit will flow into portion **60*a* or 60*b*, and commence to fill the depression 60; this causes the body 52 to rise and, as a consequence thereof, the mercury switch 56 will cause contact between terminal 40 and a terminal 62 which is connected to line 14. Hence, the solenoid valve will energize and shut off water flow through the conduit 26**.

It will be understood that the use of the term "contactor", in connection with the mercury switch 56, is a euphemism for the mercury, the latter, in fact, being the contactor.

In an alternative embodiment, the ancillary power line 34 has an electrically-operated horn 64 interpositioned therein. Therefore, when the solenoid valve is actuated to shut-off the water flow, the horn 64 will sound to alert the householder.

The system 10 functions with any liquid conduit, whether pressured by mechanical, hydraulic, or pneumatic means, or by gravity, and with any liquid: i.e., petroleum, solvents, etc.

While I have described my invention in connection with a specific embodiment thereof, it is to be clearly understood that this is done only by way of example, and not as a limitation to the scope of my invention as set forth in the objects thereof and in the appended claims. For example, in lieu of the foam plastic body 52, a cork body may be used, or an evacuated bulb. These, and all other modifications of the invention, which may occur to others, are deemed to be within the ambit of the invention and comprised by the following claims.

I claim:

1. For use in a liquid shut-off system, a float switch, comprising:

a shell;

a pivot pin fixed in said shell and in traverse thereof;

a sleeve rotatably encompassing an intermediate portion of said pin;

a buoyant element coupled at one end thereof to said sleeve;

a liquid switch carried by said element; and electrical lines, coupled at first ends thereof, to said switch; wherein said shell has an unapertured top, and a continuous wall depending from said top; and said wall has only (a) a pair of apertures in which said pin is fixed, and (b) a third aperture through which said electrical lines pass.

2. A float switch, according to claim 1, wherein: said element comprises a body of foam plastic.

3. A float switch, according to claim 1, wherein: said liquid switch is a mercury switch.

* * * * *